US006338161B1

(12) United States Patent
Ali Muhammad

(10) Patent No.: US 6,338,161 B1
(45) Date of Patent: Jan. 15, 2002

(54) RIPPURR "THE RIP-AWAY LINGERIE"

(76) Inventor: Khaleelah Ali Muhammad, 3562-I Meadowglen Village La., Doraville, GA (US) 30340

( * ) Notice: Subject to any disclaimer, the term of this patent is extended or adjusted under 35 U.S.C. 154(b) by 0 days.

(21) Appl. No.: 09/411,673

(22) Filed: Oct. 7, 1999

Related U.S. Application Data

(60) Provisional application No. 60/103,465, filed on Oct. 8, 1998.

(51) Int. Cl.[7] ..... A41B 9/00

(52) U.S. Cl. ..... 2/78.1; 2/69

(58) Field of Search ..... 2/78.1, 78.2, 78.4, 2/105, 80, 83, 75, 74, 400, 403, 109, 111, 114, 406, 407, 408, 227, 228, 238, 69, 79, 70, 67, 106, 912–915, 919; 450/1, 82, 85, 86

(56) References Cited

U.S. PATENT DOCUMENTS 1,190,448 A * 7/1916 Murray ..... 2/69
1,489,046 A * 4/1924 Thompson ..... 2/114
RE16,357 E * 6/1926 Frankel ..... 450/1
3,079,611 A * 3/1963 Boryszewski ..... 2/69
3,116,491 A * 1/1964 Previdi et al. ..... 2/105
4,145,763 A * 3/1979 Abrams et al. ..... 2/403
5,097,535 A * 3/1992 Dye et al. ..... 2/69
5,628,064 A * 5/1997 Chung ..... 2/70

OTHER PUBLICATIONS

Fredericks of Hollywood Catalog—pp.62, (e),(g),66(c),Oct. 23, 1999.*

* cited by examiner

*Primary Examiner*—Gloria M. Hale

(57) ABSTRACT

Conforming women under and/or outer garments made with loom fabrics and processed materials. Assembled with seams of hook and loom type adhesive at left and right sides of garment and crotch, and the top end is divided by two straps affixed to garment in the back and attaches to the front with fasteners providing shoulder straps, a head opening and two arm openings.

1 Claim, 6 Drawing Sheets

RIPPURR "THE RIP-AWAY LINGERIE"

this application claims the benefit of Provisional No. 60/103,465 filed Oct. 8, 1998.

REFERENCE

| | | |
|---|---|---|
| 1986,792 | 9/30/32 | M. B. Calvo |
| 4,674,130 | 6/23/87 | C. A. Coudron |
| 2,782,418 | 2/26/57 | A. Garson |
| 2,504,534 | 4/18/50 | H. E. Kephart Et Al |
| 4,258,440 | 3/31/81 | M. McGowan |
| 3,116,491 | 1/7/64 | R. E. Previdi Et Al |

BACKGROUND OF THE INVENTION

1. Field of the Invention

This invention relates in general to women's wear apparel and more particularly concerns the construction and use of lingerie. This invention provides lingerie that also functions as lounge wear and has multiple uses and styles. It can function alone, and as an under or outer garment. This invention separates entirely, the front from the back and the adjustable shoulder straps detach from the front. This separation gives invention ability to interchange with multiple styles and colors of like invention to give wearer versatility.

2. Description of the Prior Art

The primary object of this invention is to provide a lingerie having detachable front & back panels and detachable straps. To provide the wearer with means for replacing front and back panels with others of different styles as requirement of lingerie for lounge wear arises.

Various types of detachable garments for people are known. Calvo, U.S. Pat. No. 1,986,792 discloses a bathing suit that detaches at the inside leg seams and side seams. Coudron, U.S. Pat. No. 4,674,130 discloses a children's sleeping bag that has a neck opening and a body insertion opening. Along the sides of the body insertion opening, hook and loom type adhesive strips are mounted along part of the length of the opening, so that arms & feet may extend through limb openings. Garson, U.S. Pat. No. 2,782,418 discloses a brassiere having detachable shoulder straps. Kephart Et Al, U.S. Pat. No. 2,504,534 discloses a bed jacket that detaches under arms and at sides. McGowan, U.S. Pat. No. 4,258,440 discloses shorts and top for the handicapped, which the shorts detach at the sides and the top detaches under the arms and at the sides. Previdi Et Al, U.S. Pat. No. 3,116,491 discloses a maternity blouse with interchange front panels, that detaches at the top of shoulders, down the front and at the sides. Top interchanges to accommodate women's size increase as baby grows.

Calvo, Coudron, Garson, Kephart, McGowan and Previdi provided garments for specific uses only.

SUMMARY OF THE INVENTION

This invention is primary for its construction, though it can be crafted in multiple styles from one structure, it attaches and detaches in one unique fashion.

Another object of this invention is to provide lingerie that will close with fasteners along the seams, as follows: one straight seam along each of the side lines of the garment from top to bottom, and a third seam at the crotch. The shoulder straps are permanently affixed to the back portion, female fasteners at the opposition end of straps that fastens to the male fastener affixed to the inside at top of front portion, which portions have arms and neck holes therein. Lingerie so made, the front and back portions are completely separable from each other.

Another object is to provide lingerie having plural parts that can be individually removed and laundered.

Still another object is to provide lingerie as described in which individual panels can be removed for changing color and style schemes of the lingerie at will. According to the fabric, design and finish, this invention can be either an undergarment or outer garment; it may be teddy, chemise or a nightgown. Along with being worn as lingerie, this invention can be wore as undergarment, suit top, lounge wear or bathing suit cover.

Another object is to provide a method of producing garments made with a minimum of material and labor and at the same time are constructed for a comfortable, smooth, accurate fit for women of various sizes, shapes and some disabilities.

A final object is to provide lingerie that is stylish and playfully fun. Though any fastener can be used, the use of hooks and looms and plastic snaps are chosen to give the full advantage of invention; thus providing the playful quick rip-away effect of the garment from the body. This invention is stylish and playful. This lingerie can be ripped apart from the front-to-back, from the top-to-the-bottom or from side-to-side, it's sexy, it's fun it's the Rippurr, the rip-away lingerie.

With these and related objects in view this invention consists in the constructing arrangement and combination of parts as will be more fully understood from the following description, which, however, is capable of expression other than as particularly described and illustrated without departing from the inventive concept.

BRIEF DESCRIPTION OF THE DRAWINGS

In the accompanying drawings, wherein an illustrative embodiment of the invention is disclosed.

DESCRIPTION OF THE PREFERRED EMBODIMENT

Figure 1:
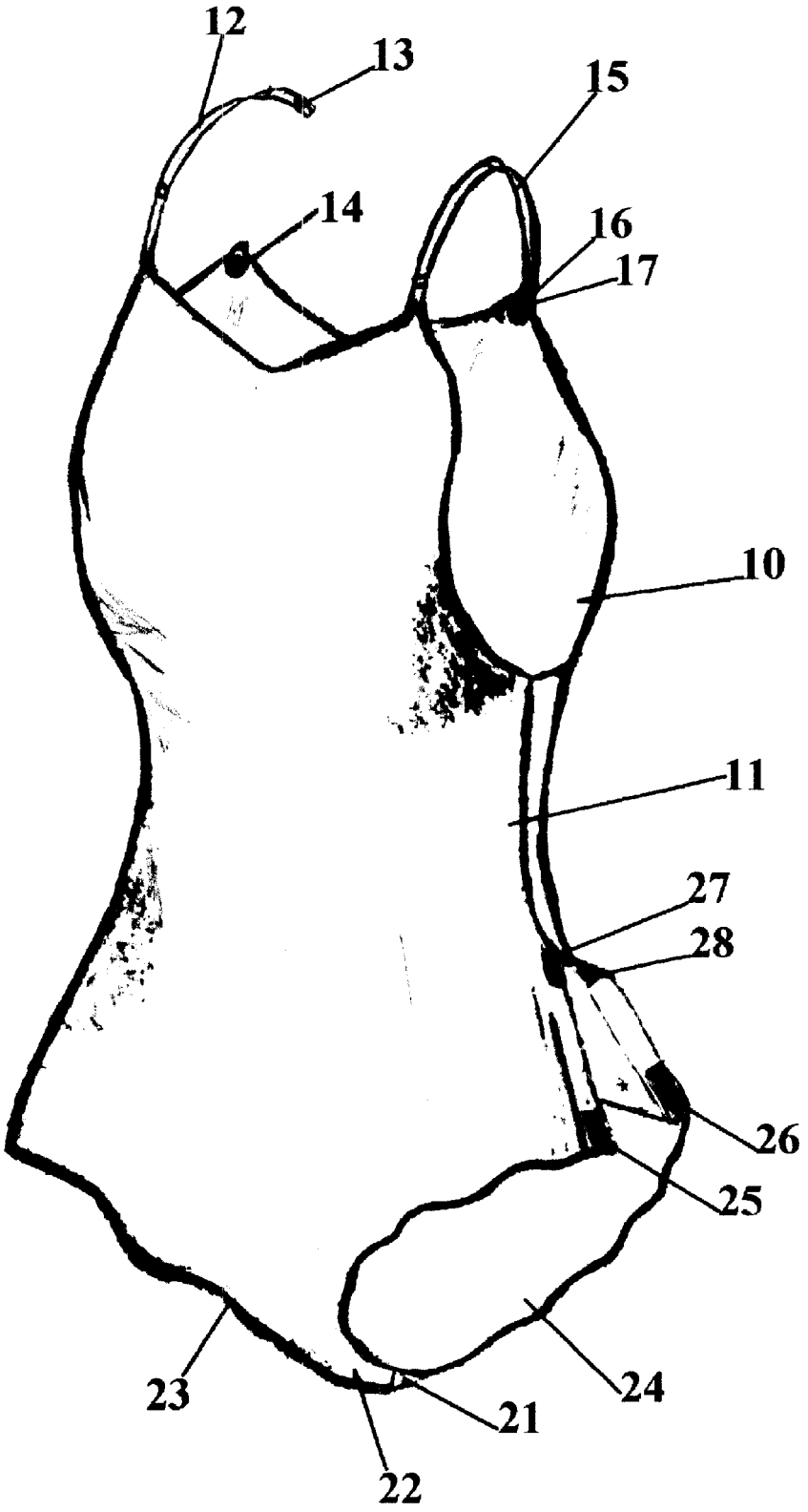
FIG. 1 is a perspective view of the garment viewed from the rear right, showing the front portion coming together with the back portion at the hook and loom seam, and showing straps, one attached and one viewing how straps comes together with front portion.

In the drawing like reference numerals indicate like parts.

Figure 2:
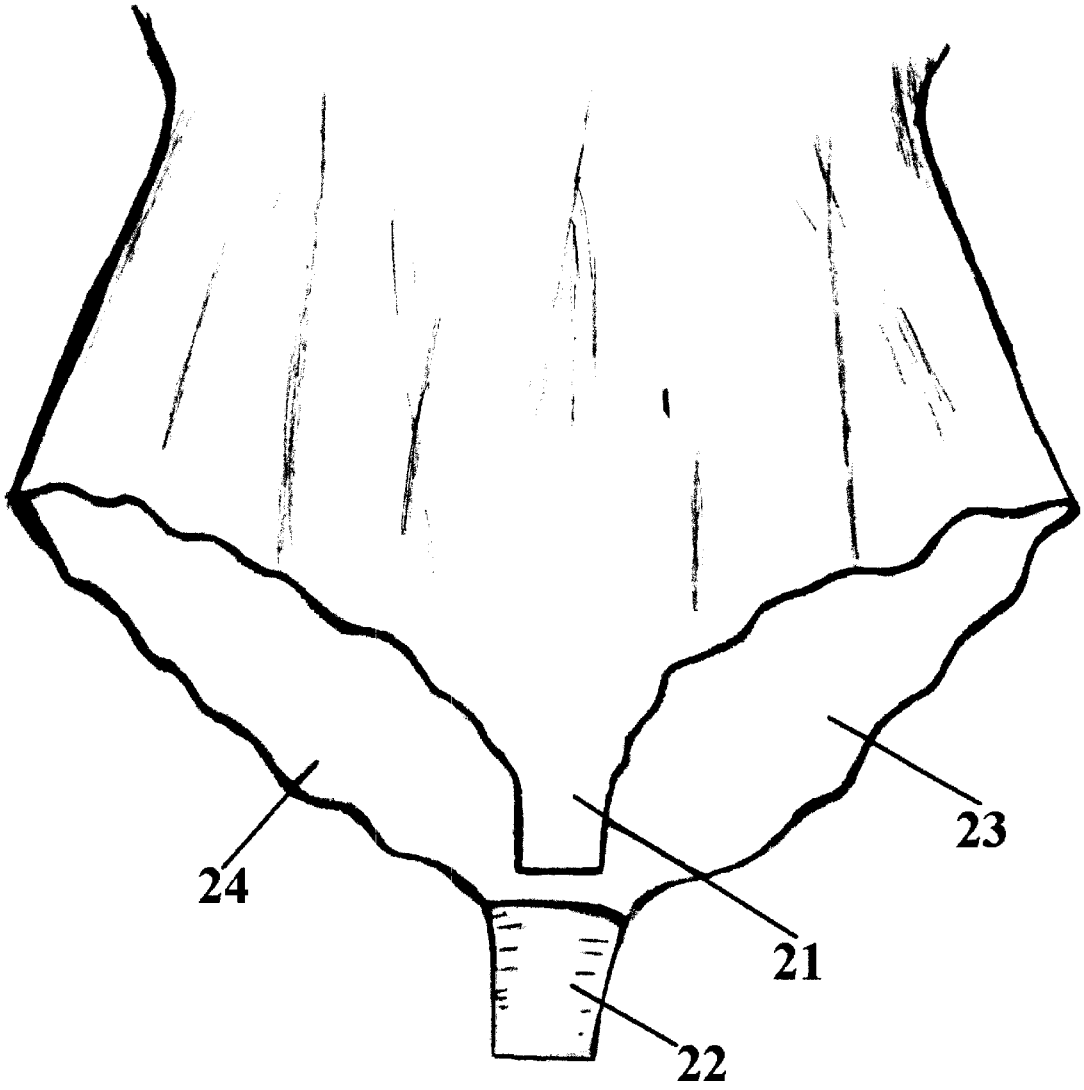
FIG. 2 is a view of the panty portion of the garment in Figure with the back closure flap attached to the front flap.
Figure 4:
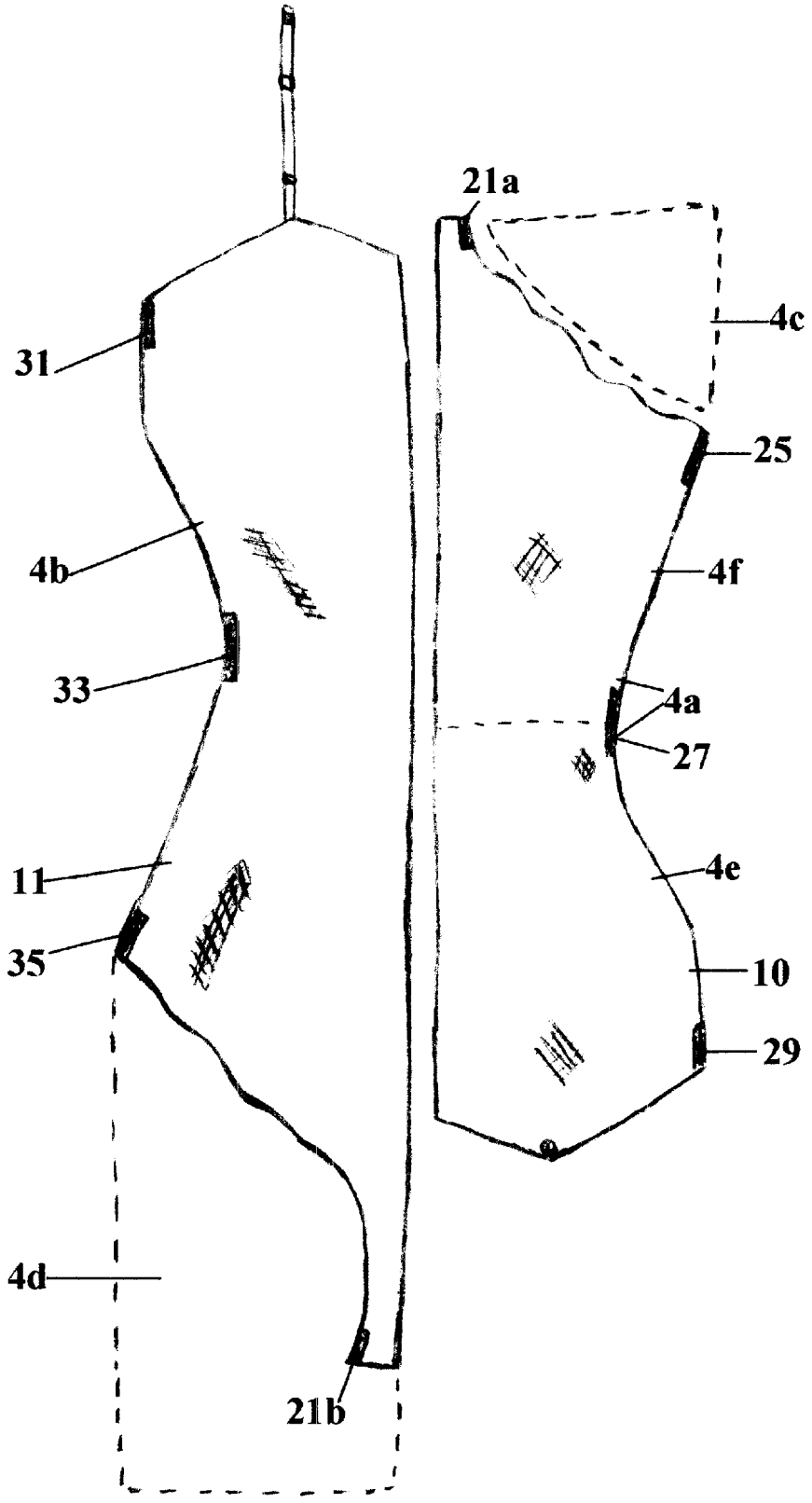
FIG. 4 shows the shape of the panels and parts for one side of the front and back sections of garments, broken lines view panels for multiple styles.
Figure 5:
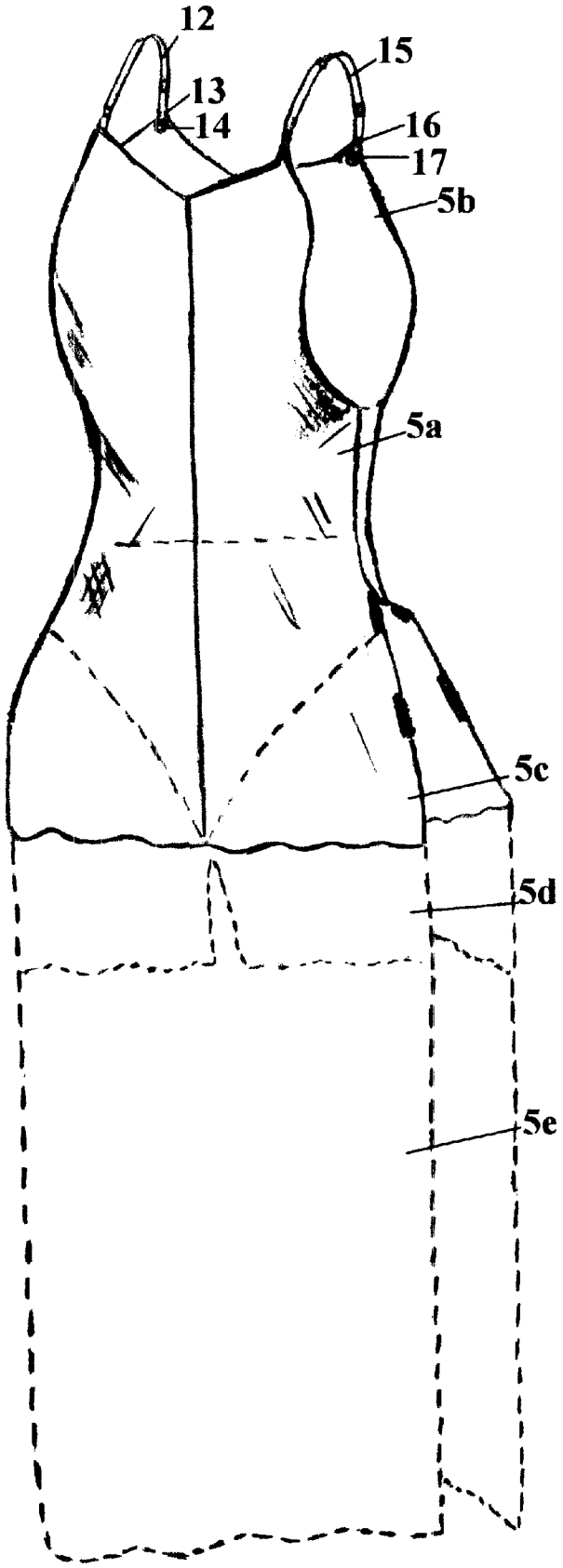
FIG. 5 is a perspective view of garment showing multiple styles with broken lines.

In the drawing reference numeral 1 indicates a teddy having a front 10 and back 11 and shoulder strap 12, in its detached form viewing 13 (the female fastener) & 14 (the male fastener) and shoulder strap 15, in its attached form viewing 16 (the female fastener) and 17 (the male fastener)

together, at the top thereof and being cut away as indicted at 18 to accommodate the neck and head; and being cut away as indicated at 19 and 20 to form armholes for the arms and shoulders. The upper portion of this garment, though it can be formed in more than one piece as indicated in FIG. 4, 5 & 6, is formed here in one piece, and at the bottom the crotch 21 & 22 and sides come together and form the leg areas 23 & 24. The front and back portions of this lingerie are entirely independent and separable from each other. The front and back portion of the lingerie are fastened together by hook and loom fasteners 25 & 26 (shown), 27 & 28 (partially shown), 29 & 30, 31 & 32, 33 & 34, 35 & 36 (partially shown in FIG. 4) along right and left sides, and at the crotch 21 & 22 (shown in FIG. 2), as will now be described.

Garment is conformed to fit body closely giving the wearer the option to wear this garment alone or under other garments such as a suit jacket, blouse or dress.

Figure 6:
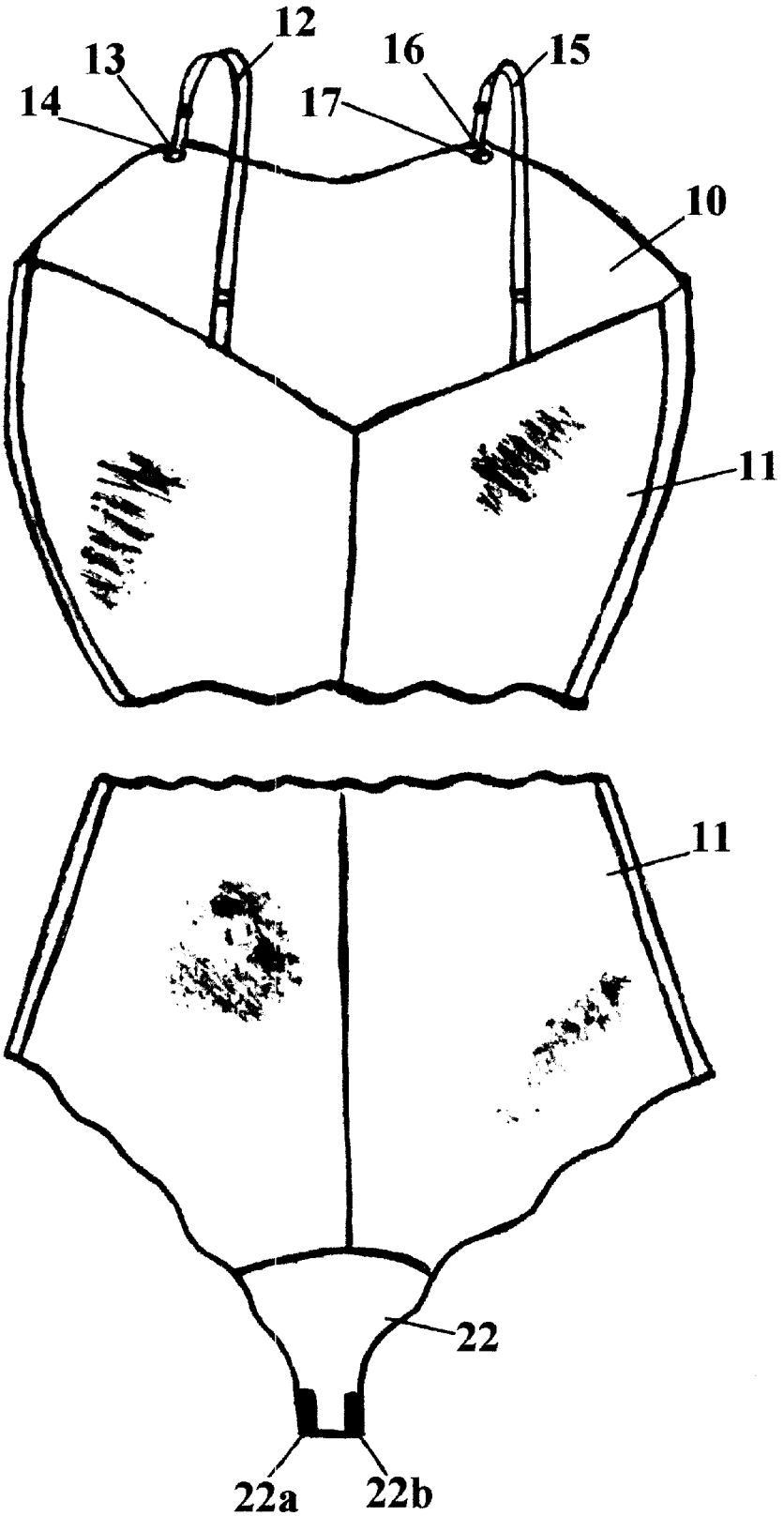
FIG. 6 is a back elevational view, with the midriff cut away, of garment shown in FIG. 1, FIG. 3 and Panels f & g of FIG. 4.

Drawing reference numeral 2 indicates the crotch 21 & 22 and legs 23 & 24 areas. The front crotch portion 21 viewing looms 21*a* & 21*b* (shown in FIGS. 4 & 6) and the back crotch portion 22 viewing hooks 22*a* & 22*b* (shown in FIGS. 4 & 6) are attached together to form the crotch area viewed in drawing reference numeral 1 and 3.

Drawing reference numeral 3 is a perspective view of invention from front view.

Drawing reference numeral 4 indicates panels front 10 (inside of garment) with male fastener and with adhesive looms at side and crotch; and back 11 (right side of garment) with strap 12 in affixed form, with female fastener and adhesive hooks at side and crotch. Panels can be cut on fold for one front and one back portion or straight of grain for two front and two back portions. Front portion 10, looms 25, 27, 29 (shown), 31, 33, 35 (not shown) and 21*a* (shown) & 21*b* (not shown); and shoulder straps male fasteners 14 (shown) & 17 (not shown) are all attached together with back portion 11, hooks 26, 28, 30 (shown), 32, 34, 36 (not shown) and 22*a* (shown) & 22*b* (not shown); and shoulder straps 12 (shown) and 15 (not shown) and female fasteners 13 (shown) & 16 (not shown) form perspective view in drawings 1, 3, and 5.

Figure 3:
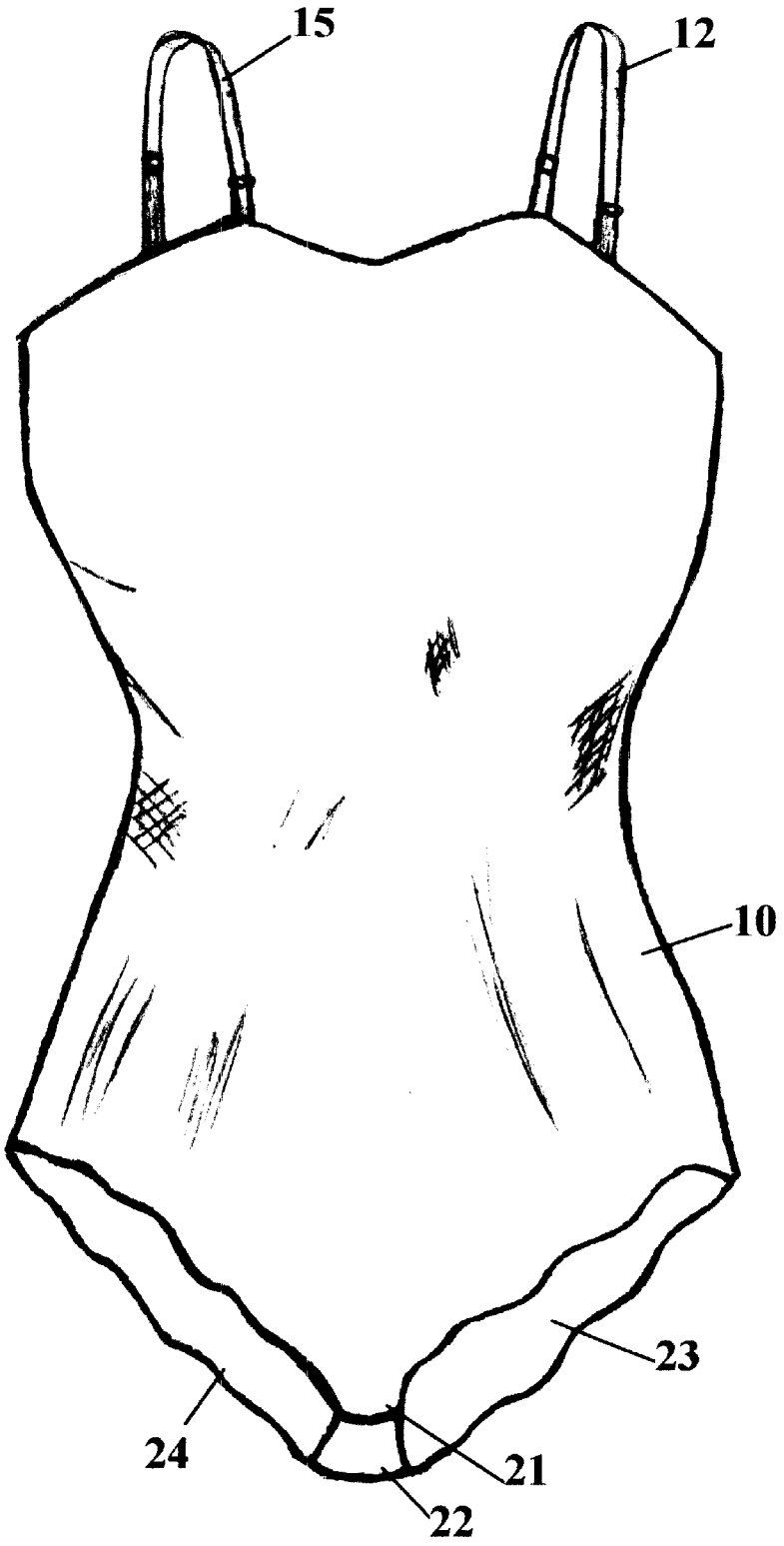
FIG. 3 is a perspective front view of the garment embodying the invention.

Be it understood that although FIGS. 1 & 3 front 10 and back 11 portions are viewing each as a single piece of fabric, portions may in fact be made up of sections which are stitched or otherwise attached together to obtain the exact shape and tailoring designed. Be it also understood that although the preferred use is hooks and looms for invention sides and crotch areas, any fastener that can be pulled apart may in fact be used to attach garment together.

Drawing reference 4 also indicates by broken line (for cut lines) that though invention body style is expendable to multiple interchangeable styles, the garment construction does not change. Adding panel 4*c* to the bottom of panels front 10 and back 11 gives the style of a teddy with a skirt as indicated by broken lines in drawing 5*c*. 4*d* & 5*e* cut short or long, changes garment to a chemise or gown as indicated by broken lines. 4*a* cut away garment at midriff for 4*e* & *f* and add elastic to waist of 4*f* to form a camisole top and french-cut shorts as indicated in drawing 6; cutting bottoms with portion 4*c* forms garment to boxer shorts as indicated in 5*d* by broken lines in drawing 5. Garment edges are completed with a rolled edge, giving a lettuce cut along bottom edges.

It is herein indicated that the present invention is particularly applicable to lingerie. However, it will be apparent that the same may be used in connection with lounge wear (long & short tops and bottoms), slips and other garments; therefore it is to be understood that its application to lingerie is illustrative only and is to be taken to comprehend any other garments on which the construction can be satisfactorily employed. The choice of hooks and looms and plastic snaps are used in this invention, providing garment with easy and quick detaching by simply pulling front or back or sides of garment away from body with a quick thrush, giving the sound of garment ripping thus giving invention the name of the Rippurr, the rip-away lingerie.

What I claim is:

1. An undergarment comprising:

a front panel and a rear panel, each of one piece construction and wherein each panel includes a top, a bottom and a middle portion; wherein each panel is bounded by first and second side edges, a top edge and a bottom edge including a crotch piece;

wherein hook and loop fastener pieces are located on the side edges at the top, middle and bottom portions;

wherein shoulder straps are attachably joined to the rear panel at the said top edge;

the said crotch piece includes a crotch piece extender and hook and loop complementary fasteners; and wherein the hook and loop fastener on the said front and rear panels, on said shoulder straps and on said crotch piece enables said two front and rear panels to be readily separated from one another.

* * * * *